US008992814B1

(12) United States Patent
Manthei

(10) Patent No.: US 8,992,814 B1
(45) Date of Patent: Mar. 31, 2015

(54) METHOD FOR DRY CASTING CONCRETE BLOCKS

(75) Inventor: Jeremy L. Manthei, Charlevoix, MI (US)

(73) Assignee: Rosetta Hardscapes, LLC, Charlevoix, MI (US)

( * ) Notice: Subject to any disclaimer, the term of this patent is extended or adjusted under 35 U.S.C. 154(b) by 445 days.

(21) Appl. No.: 13/167,658

(22) Filed: Jun. 23, 2011

Related U.S. Application Data

(60) Provisional application No. 61/357,963, filed on Jun. 23, 2010.

(51) Int. Cl.

| | |
|---|---|
| ***B28B 3/02*** | (2006.01) |
| *B28B 7/20* | (2006.01) |
| *B28B 7/36* | (2006.01) |
| *B28B 7/00* | (2006.01) |
| *E02D 29/02* | (2006.01) |

(52) U.S. Cl.
CPC ..... *B28B 7/0079* (2013.01); *B28B 7/0064* (2013.01); *B28B 7/20* (2013.01); *B28B 7/007* (2013.01); *B28B 7/366* (2013.01); *B28B 7/0097* (2013.01); *B28B 3/02* (2013.01); *E02D 29/025* (2013.01)
USPC ..... 264/333

(58) Field of Classification Search
CPC ..... B28B 7/0079; B28B 7/0064; B28B 7/20; B28B 7/007; B28B 7/366; B28B 7/0097; B28B 3/02
USPC ..... 264/333
See application file for complete search history.

(56) References Cited

U.S. PATENT DOCUMENTS

| | | | | |
|---|---|---|---|---|
| 990,437 | A * | 4/1911 | Hartley | 249/101 |
| 4,389,036 | A * | 6/1983 | Abou-Ezzeddine | 249/120 |
| 5,484,263 | A * | 1/1996 | Nagaraj et al. | 415/200 |
| 6,224,954 | B1 * | 5/2001 | Mitchell et al. | 428/34.2 |
| 2008/0174041 | A1 * | 7/2008 | Firedman et al. | 264/71 |

* cited by examiner

*Primary Examiner* — Christina Johnson
*Assistant Examiner* — Patrick Butler
(74) *Attorney, Agent, or Firm* — MacMillan, Sobanski & Todd, LLC

(57) ABSTRACT

A method for dry casting concrete block using a resilient mold having a cavity for forming a block face and a form having a block body forming cavity. The form may be offset from the mold to provide steps where the block face joins the body for aligning stacked blocks. Alternately, the form cavity may have a dimension smaller that the height of the block face and can be offset to form a step between the block face and either the top or bottom of the block. Alternately, an insert may be placed in the form adjacent the mold for forming a downwardly projecting lip along the back of the block. Blocks are formed using a dry cast concrete block machine. After casting, the form is removed from the block. The block remains supported on the mold until after it has cured.

1 Claim, 4 Drawing Sheets

METHOD FOR DRY CASTING CONCRETE BLOCKS

CROSS-REFERENCE TO RELATED APPLICATIONS

Applicants claim priority to U.S. Provisional Patent Application Ser. No. 61/357,963 filed Jun. 23, 2010.

STATEMENT REGARDING FEDERALLY SPONSORED RESEARCH OR DEVELOPMENT

Not Applicable.

TECHNICAL FIELD

The invention relates to dry casting concrete blocks having at least one decorative face.

BACKGROUND OF THE INVENTION

Two methods are commonly used for casting concrete blocks: wet casting and dry casting. In a wet casting process, liquid concrete is poured into a block form cavity and remains in the cavity until the concrete has cured sufficiently to permit removal without damage to the cast block. During the cure time, the form cannot be used for casting additional blocks. When one or more surfaces of the block are to be decorative, one or more walls of the cavity may be lined with, for example, a urethane liner shaped to impart a desired texture or decoration to the cast block. This process may be used, for example, to form concrete blocks simulating natural stone with deep irregular fissures.

In a typical dry casting process, a form having an open top and an open bottom is places on a rigid support surface such as a pallet. The form is then filled to a desired level with a relatively dry cement mixture, which is not as fluid as in the cement used in wet casting. The cement mixture is then pressed into the form cavity with sufficient pressure to form a block which has sufficient rigidity to hold its shape when the form is removed. The block is then transferred to a curing station and the form can be immediately reused for casting additional blocks. The dry casting process is commonly used for casting concrete building foundation and wall blocks. However, it has in the past only been suitable for producing blocks having a decorative surface having a relatively shallow texture or pattern. Deeper patterns have not been achievable due to problems with the relatively soft uncured block breaking when separating the block from the mold which forms the decorative surface.

In operating prior art dry casting block machines, the forms have been provided with either straight sides or with a slight relief angle so that the form can be separated from the uncured blocks without breaking the blocks. This has prevented use of the forms for imparting projections and notches on the sides of the blocks.

BRIEF SUMMARY OF THE INVENTION

According to the invention, a method is provided for dry casting concrete blocks which can have highly textured faces. The method also allows casting blocks which have either a top surface or a bottom surface which is offset relative to the face of the block, or both the top and bottom surfaces may be offset relative to the face of the block or a lip may be formed to extend below a back lower edge of the block to facilitate aligning the blocks when stacked.

The blocks are cast in a cavity defined at a bottom by a shaped resilient member which shapes the face of the block and a rigid form which shapes the body of the block. A back of the block is located at an open top of the cavity.

Various objects and advantages of the invention will become apparent from the following detailed description of the invention and the accompanying drawings.

DETAILED DESCRIPTION OF THE INVENTION

In a conventional dry casting block machine, a form for shaping sides of the block is lowered onto a pallet or other rigid support surface. The form has an open top and an open bottom and may have a single cavity for casting a single block or may have a plurality of cavities for simultaneously casting a number of concrete blocks. Each cavity is then filled with a dry casting concrete mixture. One or more shoes or plungers are mounted on the machine to be positioned above each cavity. The shoes have the same shape and size as the adjacent form cavities. The plungers are then lowered into the top of the form cavities and a high pressure is applied to each plunger for pressing and compacting the dry cast concrete in the cavity. The applied pressure may be, for example, in the range of 2,000 to 10,000 pounds, or more. It should be appreciated that higher pressures may be required when larger blocks are formed. After the block or blocks are formed, the pressure on the shoes is reduced to a level for holding the blocks on the pallet while the shoes are lifted from the blocks, and the shoes are then retracted. The blocks are then transferred to a curing area.

It is known, for example, in U.S. published patent application No. 2008/0174041, the disclosure of which is incorporated herein, that a textured mold for forming the face of a concrete block can be positioned on a support surface in a dry cast block machine and that a form can be positioned over the mold for defining a cavity in which a block is cast. The cavity is filled with the dry cast concrete mix and a shoe is lowered into the cavity to compress the concrete mix. The form is then raised, leaving the block supported on the mold. The block is then moved to a curing station before separating the block from the mold. This process has been used in the past only for forming blocks having straight sides and a face which does not extend past any of the sides, top and bottom of the block body.

Figure 1:
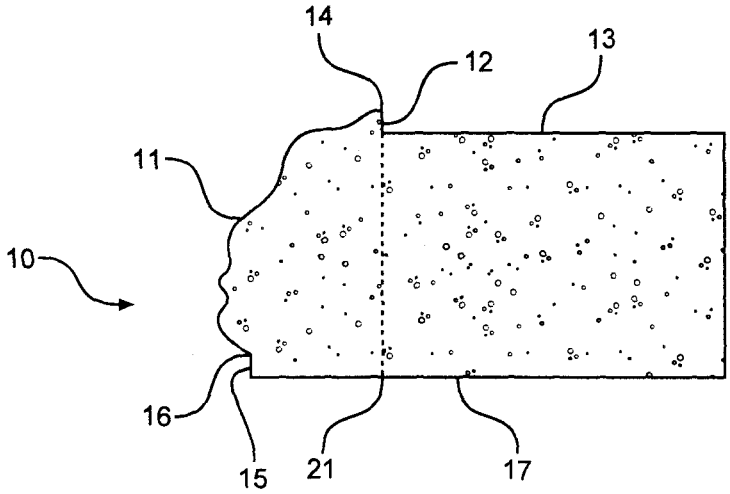
FIG. 1 is a side elevational view of a wall block having a highly textured face and a step on the top of the block to the rear of the face according to a second embodiment of the invention.
Figure 2:
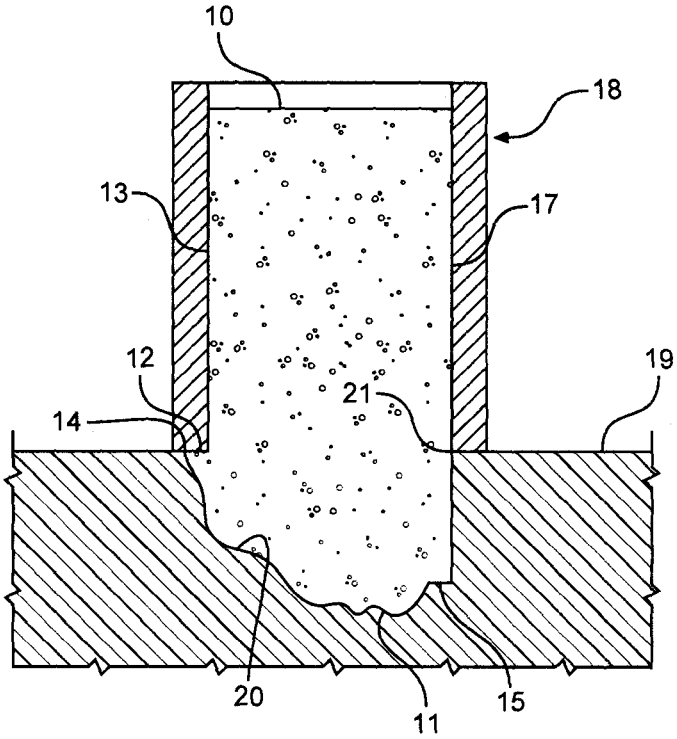
FIG. 2 is a cross sectional view through a form and a resilient member for dry casting the block of FIG. 1 in a dry cast block machine.

FIGS. 1 and 2 illustrate a one embodiment of a method for dry casting concrete blocks in a conventional dry cast block casting machine. FIG. 1 shows a side elevational view of a block 10 cast according to the method. The block 10 has a textured face 11 which may simulate weathered natural stone with deep erosion grooves and irregularities. Behind the face 11, a step 12 is formed so that a top 13 of the block 10 is lower than an upper edge 14 of the face 11. A step 15 extends below a lower edge 16 of the face 11 to a bottom 17 of the block 10. When one block 10 is stacked on another, lower block 10 to form a wall (not shown), the step 15 abuts the step 12 to position the face of the upper block slightly to the rear of the face of the lower block so that the wall will have an incline and improved stability.

FIG. 2 is a cross sectional view of a form 18 and a urethane mold 19 for casting the block 10. The mold 19 has a cavity 20 for forming the shaped face 11 of the block 10 and a portion of the bottom 17 of the block up to a point 21 on the bottom 17 opposite the step 12. The form 18 has a vertical central opening or cavity 22 which forms the portion of the block 10 to the rear of the upper step 12 and the point 21. A side 23 of the form 18 overlaps a portion of a top of the mold cavity 20 for forming the step 12 on the top of the block 10. As with the first embodiment of the invention, after the block 10 is cast, the form 18 is pulled away from the block 10 while the block 10 remains supported on the mold 19. The block 30 and the mold 19 are then moved to a curing area. After the block 10 has cured, the mold 19 is stripped from the block and is returned to the area of the block machine for use in casting another block.

It should be noted that the mold cavity 20 may be shaped so that the step 15 is either straight or curved across the width of the block 10. Providing a curved or arcuate shape to the step 15 across the width of the block 10 can facilitate arranging stacked blocks in a wall to form a curved wall. It also should be noted that the step 15 is formed by the shape of the mold cavity 20. The mold cavity 20 may be modified to move the step 15 from the forward position on the face shown in FIGS. 1 and 2 to any desired location back towards the point 21 by simply modifying the design of the mold cavity 20.

Figure 3:
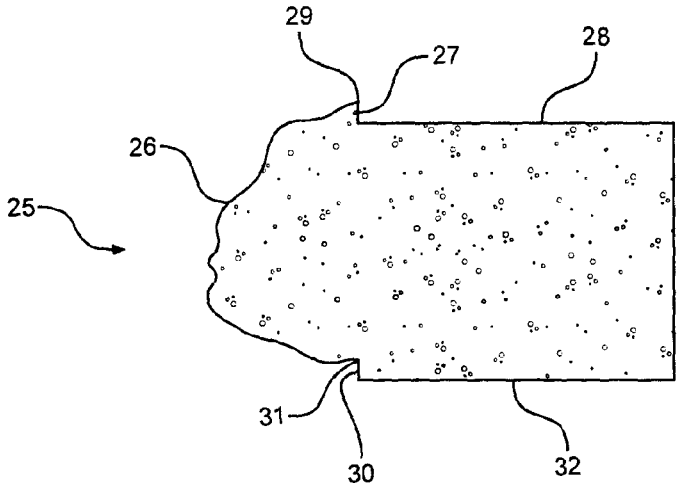
FIG. 3 is a side elevational view of a wall block having a highly textured face and steps on the top and on the bottom of the block to the rear of the face according to a third embodiment of the invention.
Figure 4:
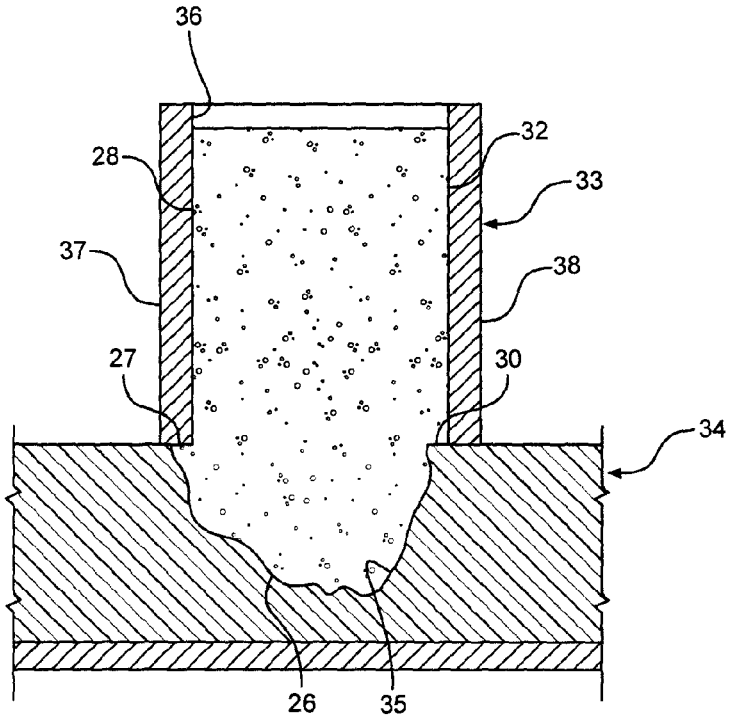
FIG. 4 is a cross sectional view through a form and a resilient member for dry casting the block of FIG. 3 in a dry casting machine.

FIGS. 3 and 4 illustrate a third embodiment of a method for dry casting concrete blocks in a conventional dry cast block casting machine. FIG. 3 shows a side elevational view of a block 25 cast according to the method. The block 25 has a textured face 26 which may simulate weathered natural stone with deep irregular erosion grooves and irregularities. Behind the face 26, a step 27 is formed so that a top 28 of the block 25 is lower than an upper edge 29 of the face 26. A step 30 extends below a lower edge 31 of the face 26 to a bottom 32 of the block 25. The steps 27 and 30 are vertically aligned. When one block 25 is stacked on a lower block 25 to form a wall (not shown), the steps 27 and 30 abut to position the face 26 of the upper block 25 directly above the face 26 of the lower block so that the wall will be vertical.

FIG. 4 is a cross sectional view of a form 33 and a resilient mold 34 for casting the block 25. The mold 34 has a cavity 35 which is shaped to define the face 26 of the block 25 and the form 33 has a vertical opening or cavity 36 with sides 37 and 38 spaced for forming the top 28 and the bottom 32, respectively, of the block 25. As shown, the form 33 is offset relative to the mold cavity 35 for forming the steps 27 and 30 on the block 25. The size of the steps 27 and 20 will be determined by the amount of offset between the form 33 and the mold cavity 35. If no steps are needed, then the form opening 36 is aligned with the mold cavity 35 while the block is formed. Further, if opposing steps are desired on the side of the cast block, it is only necessary to offset the form 33 relative to the mold cavity 35 is a direction perpendicular to the FIG. 4 view.

Figure 5:
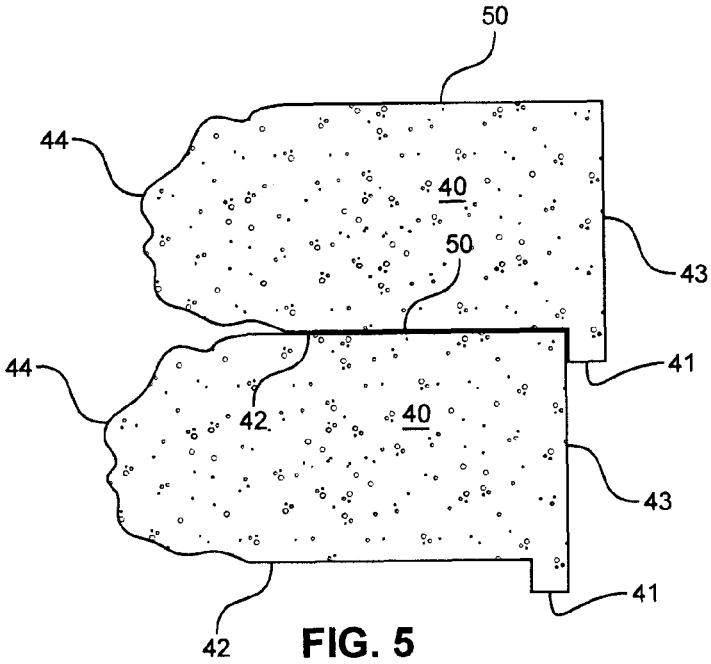
FIG. 5 is a side elevational view of a wall block having a highly textured face and a lip projecting from the lower rear edge of the block across the width of the block according to a fourth embodiment of the invention.

FIG. 5 is a side view of two stacked blocks 40, each of which has a lower lip 41 which extends below a bottom surface 42 of the block along a back 43 of the block 40. Each block 40 has a shaped face 44. The block faces 44 may simulate, for example, natural stone blocks. The lip 41 on each block 40 aligns the block with a lower block in the stack so that the face of the upper block is positioned slightly behind the face of an adjacent lower block in the stack.

Figure 6:
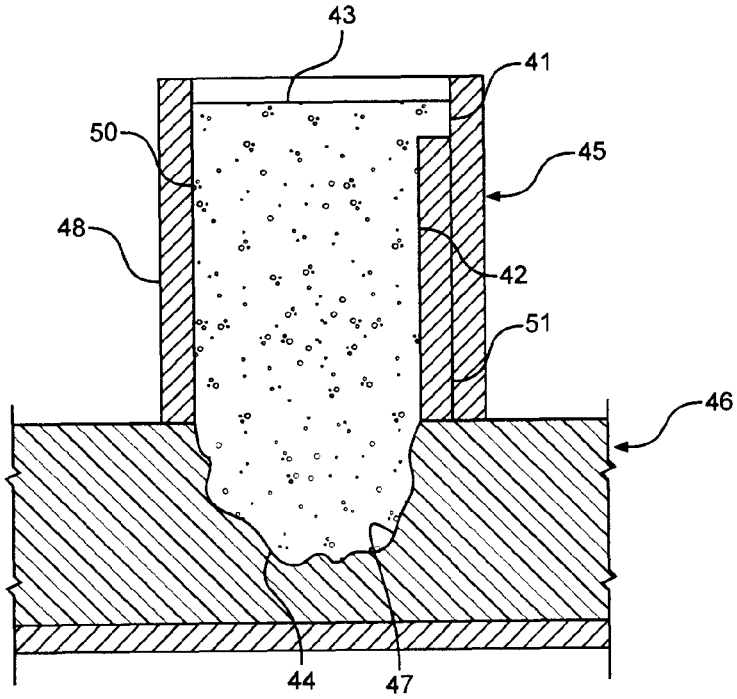
FIG. 6 is a cross sectional view through a form for dry casting the block of FIG. 5.

FIG. 6 shows a form 45 and a resilient mold 46 for casting the block 40 in a conventional dry cast block machine according to a fourth embodiment of the invention. The mold 46 has a shaped cavity 47 for forming the face 44 of the block 40. The form 45 has a width the same as the height of the block 40 plus the lip 41. A side 48 of the form 45 is aligned with an edge 49 of the cavity 47 for forming a top 50 of the block 40 which is flush with the upper edge of the block face 44. A core 51 is positioned in the form 45 for forming the bottom 42 of the block 40. The core 51 may be molded longitudinally into an opening (not shown) in the form 45 and held there while a block 40 is cast, and then withdrawn from the form before withdrawing the form from the cast block 40. After casting, the block 40 and the mold 46 are moved to a curing area. Alternately, the core 51 may be positioned in the form 45 prior to casting a block. The core 51 may either pulled from the block 40 or may remain with the block 40 during the cure time after the form is separated from the block 40. The core 51 may be disposable, such as made from a foam plastic material, or it may be more permanent, such as made from polyurethane or another durable plastic material or from metal.

Figure 7:
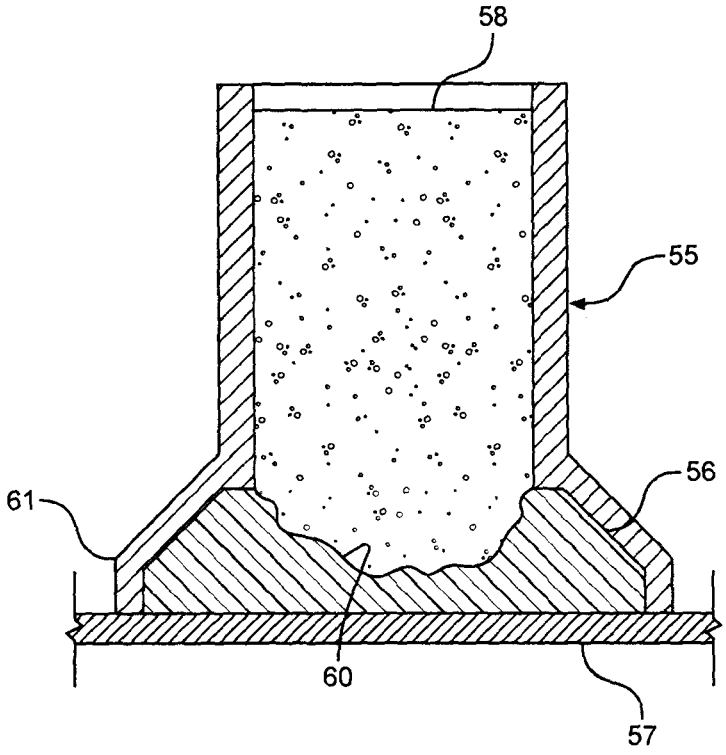
FIG. 7 is a cross sectional view through a form for dry casting a wall block having a highly textured face.

FIG. 7 is a cross sectional view through a rigid form 55, a resilient mold 56 which is preferably made from urethane, and a rigid support plate or pallet 57 for manufacturing a dry cast block 58 according to a fifth embodiment of the invention. The interior 59 of the form 55 and a shaped recess 60 in the mold 56 form a cavity in which the block 58 is dry cast in a conventional dry cast block machine. The form 55 includes a lower skirt 61 which rests on the pallet 57 and presses against the perimeter of the mold 56 for providing support to the mold 56 when the dry concrete mix is compacted to form the block 58.

The various methods described above for dry casting concrete blocks all work with many existing dry cast concrete block machines. It will be appreciated that various modifications and changes may be made to the above described preferred embodiment of a method for dry casting concrete blocks without departing from the scope of the following claims

The invention claimed is:

1. A method for dry casting concrete blocks having a textured face comprising the steps of:

a) placing on a support surface a resilient member having an upwardly facing face cavity shaped for forming the textured face on a cast block, the face cavity having first and second opposing edges spaced apart a predetermined width, the first edge forming a top edge of the textured face and an adjoining top of a cast block and the second edge forming a bottom of the textured face;

b) positioning a rigid form on the resilient member to form a body portion of a block, said form defining a body cavity having a width greater than said predetermined width and extending above at least a portion of said resilient member face cavity for forming a body portion of a cast block, said rigid form including first and second opposing sides extending upwardly from said resilient form;

c) aligning the first side of the rigid form on the resilient member with the first edge of the face cavity whereby said second side of the rigid form is spaced from the second edge of the face cavity, and positioning an insert adjacent the second side of the form cavity to extend from adjacent the second edge of the face cavity, such insert forming a bottom surface on the cast block, and wherein said insert is spaced from a back of a cast block for forming a lip on such cast block extending below a rear portion of bottom surface of a block cast in the face and body cavities;

d) filling the resilient member face cavity and the body cavity with dry cast concrete mix;

e) compacting the dry cast concrete mix in the resilient member face cavity and the body cavity to form an uncured concrete block;

f) separating the form from the uncured concrete block;

g) curing the uncured concrete block; and h) separating the cured concrete block from the resilient member.

* * * * *